US009132932B2

(12) United States Patent
Scharfe et al.

(10) Patent No.: US 9,132,932 B2
(45) Date of Patent: Sep. 15, 2015

(54) PORTABLE COMBINATION DISHWARE SET

(71) Applicants: Kevin Larry Scharfe, Billings, MT (US); Karl Joseph Schwartz, Billings, MT (US)

(72) Inventors: Kevin Larry Scharfe, Billings, MT (US); Karl Joseph Schwartz, Billings, MT (US)

(73) Assignee: Warum Studios LLC, Billings, MT (US)

( * ) Notice: Subject to any disclaimer, the term of this patent is extended or adjusted under 35 U.S.C. 154(b) by 0 days.

(21) Appl. No.: 14/265,582

(22) Filed: Apr. 30, 2014

(65) Prior Publication Data

US 2014/0326723 A1 Nov. 6, 2014

Related U.S. Application Data

(60) Provisional application No. 61/819,145, filed on May 3, 2013.

(51) Int. Cl.

| | |
|---|---|
| ***A47G 19/02*** | (2006.01) |
| ***B65D 1/36*** | (2006.01) |
| ***A47G 19/22*** | (2006.01) |
| ***A47G 19/00*** | (2006.01) |
| ***A47G 19/06*** | (2006.01) |

(52) U.S. Cl.

CPC *B65D 1/36* (2013.01); *A47G 19/00* (2013.01); *A47G 19/02* (2013.01); *A47G 19/06* (2013.01); *A47G 19/2283* (2013.01)

(58) Field of Classification Search

CPC ..... B65D 1/36; A47G 19/00; A47G 19/22; A47G 19/2283

USPC ..... 220/23.83, 574, 23.86; 215/393; 206/502; 248/346.11

See application file for complete search history.

(56) References Cited

U.S. PATENT DOCUMENTS

| | | | |
|---|---|---|---|
| 2,960,251 | A | 11/1960 | Mariotti |
| 3,250,422 | A | 5/1966 | Parish |
| 3,756,462 | A | 9/1973 | Cain |
| 3,894,649 | A | 7/1975 | Nicholl |
| D244,902 | S | 7/1977 | Vonder Haar |
| 4,351,444 | A | 9/1982 | Majewski |
| D304,659 | S | 11/1989 | Asner |
| 5,058,737 | A | 10/1991 | Patterson et al. |
| 5,111,960 | A | 5/1992 | Zilliox |
| 5,125,363 | A | 6/1992 | McGaha |
| 5,176,283 | A | 1/1993 | Patterson et al. |
| 5,222,622 | A | 6/1993 | Laske |
| 5,234,125 | A | 8/1993 | Roberts |
| 5,301,871 | A | 4/1994 | Gross et al. |
| RE34,703 | E | 8/1994 | Zilliox |

(Continued)

*Primary Examiner* — Fenn Mathew
*Assistant Examiner* — Elizabeth Volz
(74) *Attorney, Agent, or Firm* — Antoinette M. Tease

(57) ABSTRACT

A portable combination dishware set comprising a first surface comprising a female part and a second surface comprising a male part of a fastening mechanism. The female part comprises a circular recess that forms a protuberance on the first surface, the protuberance terminating in a raised circular periphery, the raised circular periphery comprising a number of inwardly extending locking brackets, each locking bracket comprising an inner arcuate edge that joins the raised circular periphery at the first end of the inner arcuate edge and at the second end of the inner arcuate edge, and a locking channel situated directly underneath the arcuate edge of each locking bracket. The male part comprises a number of locking members, each comprising a vertical extension that connects the locking member to the second surface and a horizontal portion that extends partially around an outer circumference of a circular protrusion on the second surface.

7 Claims, 4 Drawing Sheets

(56) References Cited

U.S. PATENT DOCUMENTS

| | | | |
|---|---|---|---|
| 5,346,070 | A | 9/1994 | McSpadden |
| 5,429,231 | A | 7/1995 | McSpadden |
| 5,429,266 | A | 7/1995 | D'Oliveira et al. |
| D368,627 | S | 4/1996 | McSpadden |
| 5,593,062 | A | 1/1997 | Martin |
| 5,678,694 | A | 10/1997 | Tanaka et al. |
| 5,695,052 | A | 12/1997 | Damato |
| 5,740,912 | A | 4/1998 | Chen |
| 5,803,305 | A | 9/1998 | Perlis et al. |
| 6,129,232 | A | 10/2000 | Williams |
| 6,131,732 | A | 10/2000 | Schneider |
| 6,145,906 | A | 11/2000 | Wright et al. |
| 6,149,027 | A | 11/2000 | Rathjen |
| 6,168,813 | B1 | 1/2001 | Blazevich |
| 6,352,258 | B1 | 3/2002 | Fitzgerald et al. |
| 6,360,885 | B1 | 3/2002 | Krueger et al. |
| 6,446,828 | B1 | 9/2002 | Casteel |
| 6,474,494 | B1 | 11/2002 | Miller |
| 6,688,485 | B1 | 2/2004 | Lauer et al. |
| D507,933 | S | 8/2005 | Carmichael |
| 7,000,799 | B1 | 2/2006 | Hamre |
| 7,219,622 | B1 | 5/2007 | Powers |
| 7,225,633 | B2 | 6/2007 | DeMars |
| 7,503,464 | B2 | 3/2009 | McCain |
| D623,019 | S | 9/2010 | Wildman |
| 7,802,693 | B2 | 9/2010 | Kuhn |
| 7,956,296 | B2 | 6/2011 | Hodgson et al. |
| 7,992,714 | B1 | 8/2011 | Devault et al. |
| 8,033,420 | B2 | 10/2011 | Roseblade et al. |
| 8,342,129 | B2 | 1/2013 | Harper |
| 8,353,403 | B2 | 1/2013 | Raynor |
| 8,439,200 | B1 | 5/2013 | Sorrells et al. |
| 2001/0025850 | A1 | 10/2001 | Han et al. |
| 2004/0084458 | A1 | 5/2004 | Krueger et al. |
| 2007/0029213 | A1* | 2/2007 | Hall ..... 206/217 |
| 2009/0031962 | A1 | 2/2009 | Webber |
| 2009/0057252 | A1 | 3/2009 | Eckenrode et al. |
| 2009/0139890 | A1 | 6/2009 | Hatcher |
| 2009/0194543 | A1 | 8/2009 | Farmer |
| 2010/0224642 | A1 | 9/2010 | Beeson et al. |
| 2010/0314395 | A1 | 12/2010 | Haden |
| 2011/0162583 | A1 | 7/2011 | Rostamo et al. |
| 2011/0290697 | A1 | 12/2011 | Dalhamer |
| 2012/0103999 | A1 | 5/2012 | Weidner et al. |
| 2012/0205265 | A1 | 8/2012 | VanEss et al. |
| 2012/0234838 | A1 | 9/2012 | Cheng |
| 2012/0241338 | A1 | 9/2012 | Henry |
| 2012/0248000 | A1 | 10/2012 | Artsvelyan |

* cited by examiner

PORTABLE COMBINATION DISHWARE SET

CROSS-REFERENCE TO RELATED APPLICATION

This application claims priority back to U.S. Patent Application No. 61/819,145 filed on May 3, 2013, the contents of which are incorporated herein by reference.

BACKGROUND OF THE INVENTION

1. Field of the Invention

The present invention relates generally to the field of dishware, and more specifically, to a portable dish or plate to which a bowl, cup or similar item can be securely fastened.

2. Description of the Related Art

Before the invention described herein was introduced to the market, existing dishware did not provide a secure method of attaching a bowl and/or cup to a dish to avoid spilling of rood while eating, standing, sitting or moving from one place to another. Typical plates and bowls are not intended to be used without a table or similar flat surface underneath them. When a bowl is placed on a conventional plate, it can slide off, creating a mess or causing injury. The present invention resolves these problems by providing a dish-and-bowl or dish-and-cup combination in which the bowl or cup, as the case may be, is securely but removably attached to the dish. As used herein, the terms "dish" and "plate" are synonymous.

Other people have tried to solve the problem that is solved by the present invention, but these other inventions axe inferior to the present invention both structurally and functionally. One example is U.S. Pat. No. 2,960,251 (Mariotti, 1960). In this reference, the cup is placed on top of a saucer-like member (coaster), which is secured to the plate via an integral resilient strip that curves around the edge of the plate and underneath it. U.S. Pat. No. 3,250,422 (Parish, 1966) describes a cap and tray set in which the cup has a large cone-shaped recess underneath it, and the tray has an upwardly extending cone-shaped protrusion that fits into this recess. U.S. Pat. No. 3,756,462 (Cain, 1973) provides a nut-and-shell bowl combination in which the shell bowl has a central bore that fits over a central upstanding circular portion of the nut bowl.

U.S. Pat. No. 4,351,444 (Majewski, 1982) is another example of a plate-and-bowl combination, although the method of fastening the bowl to the plate is very different than in the present invention. In Majewski, the bowl is attached to the plate via a pivoting mechanism that allows the bowl to tilt. The interior of the bowl is segregated into partitions that allow one to keep liquid and solid substances separate from one another when the bowl is in a tilted position. The purpose of this invention is to keep cereal and milk separate, in order to maintain the crispness of the cereal, until a person is ready to eat it.

U.S. Pat. No. 5,058,737 (Patterson et al., 1991) involves a plate-and-glass assembly in which the glass is secured to the bottom surface of the plate, thereby preventing liquids from spilling out of the cap when it is attached to the underside of the plate. U.S. Pat. No. 5,111,960 (Zilliox, 1992) and U.S. Pat. No. RE34,703 (Zilliox, 1994) describe an interlocking plate and cup set in which the cup slides onto the plate via a slot in the plate that extends inwardly from the edge of the plate. U.S. Pat. No. 5,234,125 (Roberts, 1993) shows a plate with openings in the central portion of the plate for insertion of wine glasses, cups and the like. The wine glass slides into the plate via a slot that extends to the edge of the plate. The cup slides into the plate vertically and is held in place by a circumferential ridge around the cup that prevents it from sliding all the way through the opening in the plate. Alternately, the cup is tapered so that it will only slide so far through the opening in the plate and then stop when its width becomes wider than the width of the opening.

U.S. Pat. No. 5,346,070 (McSpadden, 1994) and U.S. Pat. No. 5,429,231 (McSpadden, 1995) disclose a portable food tray with recesses underneath the tray for the insertion of fingers to facilitate holding the tray. The tray also includes a recess for insertion of a cup, although the cup is not fastened to the tray by any means. U.S. Pat. No. 8,439,200 (Sorrells et al., 2013) provides a dining tray with a central T-shaped member and a pair of opposing L-shaped side members that engage rotated lateral members affixed to food containers (bowls and cups). U.S. Patent Application Pub. No. 2010/0224642 (Beeson et al.) discloses a rotatable display and server ensemble in which a centerpiece engages with a rotary turntable via snap fit interlocking components, threaded male and female features, key and socket, magnets, or combinations thereof.

Finally, U.S. Pat. Nos. D244,902 (Vonder Haar, 1977), D304,659 (Asner, 1989), D368,627 (McSpadden) and D623,019 (Wildman, 2010) cover designs for bowl-and-plate, bowl-and-bowl, and cup-and-plate combinations.

BRIEF SUMMARY OF THE INVENTION

The present invention is a portable combination dishware set comprising: a first surface comprising a female part of a fastening mechanism, the female pan comprising a circular recess that forms a protuberance on the first surface, the protuberance terminating in a raised circular periphery, the raised circular periphery comprising a number of inwardly extending locking brackets, each locking bracket comprising an inner arcuate edge with a first end and a second end, the inner arcuate edge joining the raised circular periphery at the first end of the inner arcuate edge and at the second end of the inner arcuate edge, a locking channel situated directly underneath the arcuate edge of each locking bracket; and (b) a second surface comprising a male pan of the fastening mechanism, the male part comprising a number of locking members, each of the locking members comprising a vertical extension that connects the locking member to the second surface and a horizontal portion that extends partially around an outer circumference of a circular protrusion on the second surface; wherein the number of locking brackets equals the number of locking members.

In a preferred embodiment, the first surface is atop surface of a plate, and wherein the female part of the fastening mechanism is offset from a center of the plate. Preferably, the first surface is a top surface of a plate, the top surface has an area, and the female part comprises less than one-quarter of the lop surface area of the plate.

In a preferred embodiment, each of the arcuate edges has a length, and the locking channel extends approximately two-thirds of the length of the arcuate edge. Preferably, each locking bracket has a height, each locking channel has a floor, and the floor of each locking channel is formed by a flat member that is offset from a top edge of the raised circular periphery by a distance equal to the height of each locking bracket. The flat member preferably covers an entire inner surface area of the protuberance with the exception of cutouts that form viewing windows, and the viewing windows are located directly underneath the locking brackets.

In a preferred embodiment, the male part of the fastening mechanism is recessed into the second surface so that no portion of the male part extends below a bottom periphery of the second surface. Preferably, the second surface is on apiece of dishware with an overall height, and the male part has an overall height that is no greater than one-eighth the overall height of the piece of dishware. In a preferred embodiment, the second surface is a bottom surface of a bowl, and the bowl comprises a handle with a thumb grip.

REFERENCE NUMBERS

Figure 1:
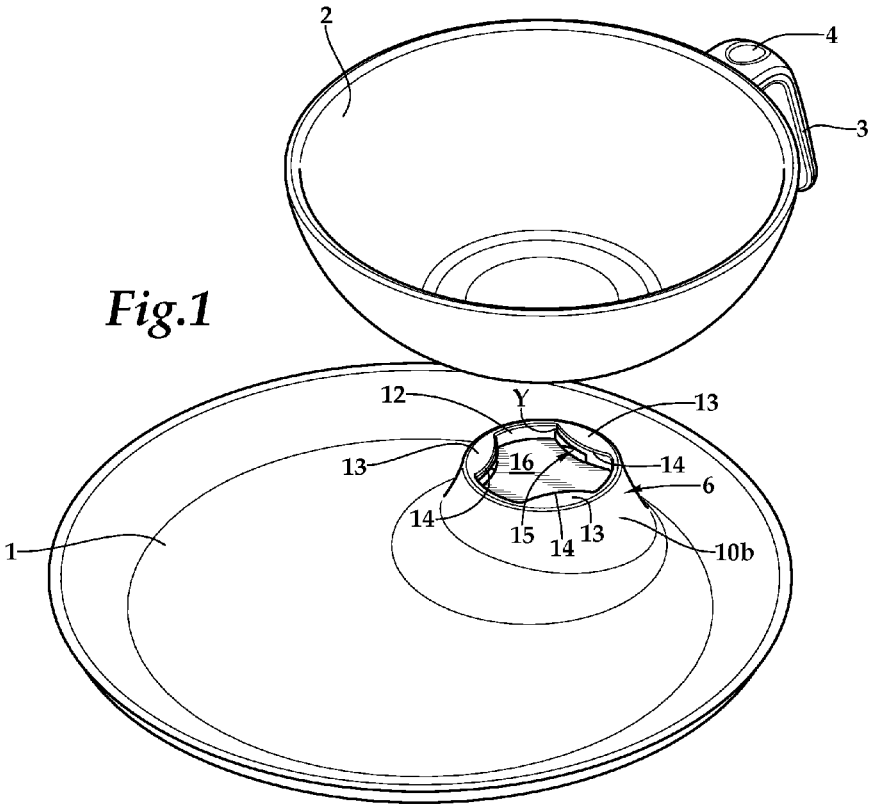
FIG. 1 is a perspective view of the present invention with the bowl detached front the plate.

1 Plate
2 Bowl (standard)
3 Handle
4 Thumb grip
5 Male part (of fastening mechanism)
6 Female part (of fastening mechanism)
7 Pocking member
7*a* Vertical extension
7*b* Horizontal portion
8 Circular protrusion
9 Bottom periphery
10*a* Circular recess
10*b* Protuberance
11 Walls (of circular recess)
12 Raised circular periphery
13 Locking bracket
14 Arcuate/concave cage (of locking bracket)
15 Locking channel
16 Flat member
17 Viewing window
18 Bowl (dipping)
19 Drinking cup

DETAILED DESCRIPTION OF INVENTION

FIG. 1 is a perspective view of the present invention with the bowl detached from the plate. In a first embodiment, the present invention comprises a plate 1 and a bowl 2. The bowl 2 preferably comprises a handle 3 with an indentation that may be used as a thumb grip 4. The underside of the bowl (see FIG. 7) comprises a male part 5 of a mechanism that fastens (or secures) the bowl 2 to the plate 1. Extending upwardly from the top surface of the plate 1 and offset from the center is a female past 6 of the same fastening mechanism. Note that the female part 6 of the fastening mechanism takes up less than one-quarter of the top surface area of the plate. The fastening mechanism is shown in greater detail in subsequent figures.

Figure 2:
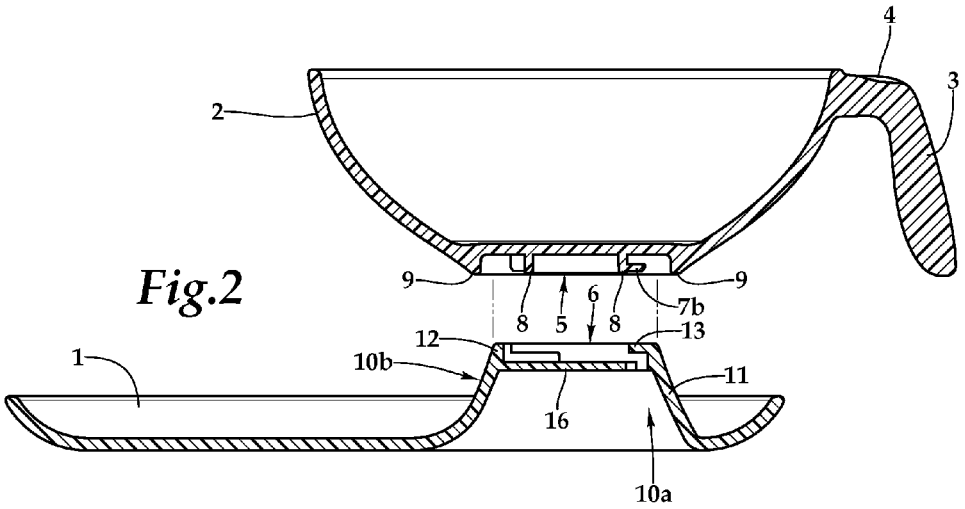
FIG. 2 is a section view of the present invention with the bowl detached front the plate.
Figure 11:
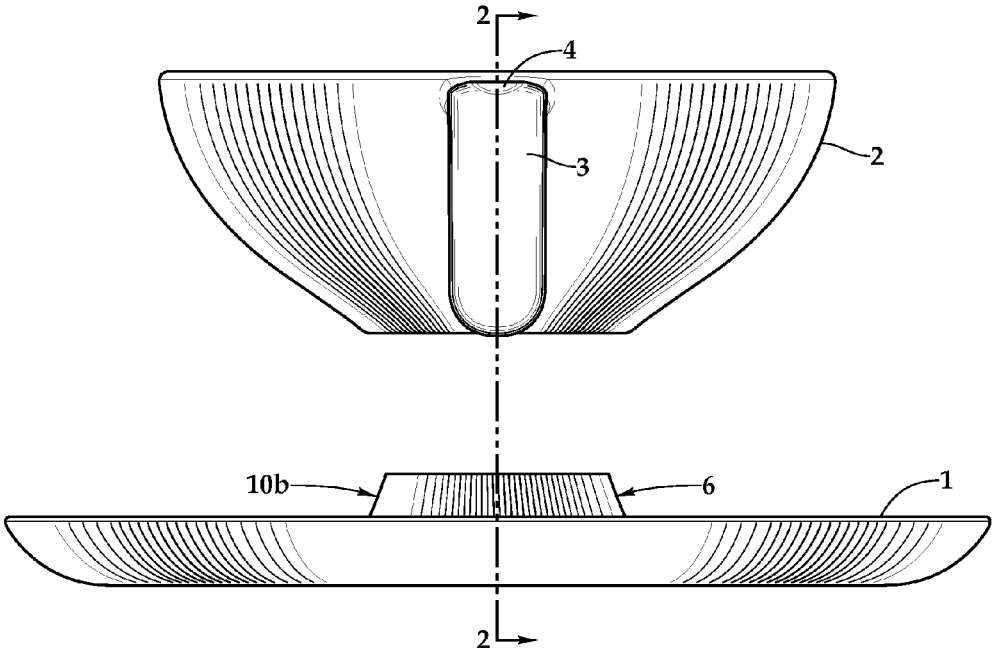
FIG. 11 is a side view of the present invention with the bowl detached from the plate.

FIG. 2 is a section view of the present invention with the bowl detached from the plate (FIG. 11 shows where the section view in FIG. 2 is taken). To secure the bowl 2 to the plate 1, the male part 5 of the fastening mechanism on the bowl 2 is positioned directly on top of the female part 6 of the fastening mechanism on the plate 1. The male part 5 of the fastening mechanism comprises three locking members 7. Each locking member 7 comprises a vertical extension 7*a* that connects it to the underside of the bowl 2 and a horizontal portion 7*b* that extends partially around the outer circumference of a circular protrusion 8 on the underside of the bowl 2. This circular protrusion 8 is situated at the center of the bottom exterior of the bowl. The entire male part 5 of the fastening mechanism is recessed into the underside of the bowl 2 so that no portion of the male part 5 of the fastening mechanism extends below the bottom periphery 9 of the bowl. The overall height of the male part 5 of the hastening mechanism is relatively shallow so as not to take up any volume inside of the bowl. In a preferred embodiment, the male part 5 is approximately ¼ inch high, and the overall height of the bowl (from the bottom periphery 9 to the top edge of the bowl) is 2.5 inches. Thus, in this particular embodiment, the overall height of the male part 5 is no greater than 1/10 the overall height of the bowl. In preferred embodiments, the overall height of the male part 5 is no greater than ⅛ the overall height of the bowl.

The female part 6 of the fastening mechanism comprises a circular recess 10*a* in the bottom of the plate 1 (as noted above, offset from the center of the plate). The walls 11 of this circular recess 10*a* form a protuberance 10*b* on the top surface of the plate. This protuberance 10*b* terminates in a raised circular periphery 12, which comprises three inwardly extending kicking brackets 13, each of which has an inner arcuate or concave edge 14 that joins the raised circular periphery 12 on either end (of the arcuate or concave edge). Directly underneath the arcuate or concave edge 14 of each locking bracket 13 is a locking channel 15. Note that the locking channel 15 extends approximately ⅔ of the length of the arcuate or concave edge 14.

Although three locking brackets 13 and three locking members 7 are shown in the figures, the present invention is not limited to any particular number of locking brackets or locking members as long as the number of kicking brackets equals the number of locking members. The floor of each locking channel 15 is formed by a flat member 16 that is offset from the top edge of the raised circular periphery 12 by a distance equal to the height of each locking bracket 13. The flat member 16 covers the entire inner surface area of the protuberance 10*b* with the exception of cut-outs that form viewing windows 17 (see FIG. 8), which are located directly underneath the locking brackets 13. Note that the flat member 16 forms the ceiling of the circular recess 10*a*.

Figure 5:
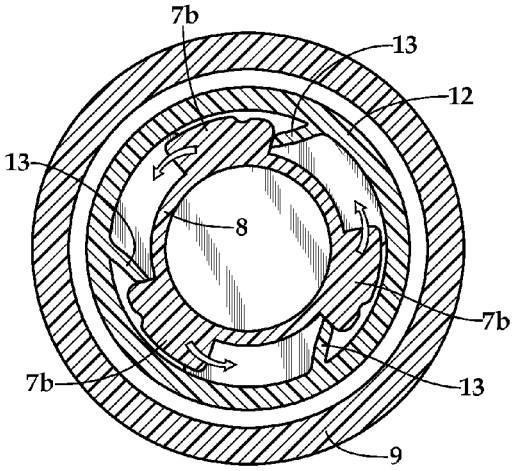
FIG. 5 is a section view of the fastening mechanism of the present invention shown in a locked position.
Figure 6:
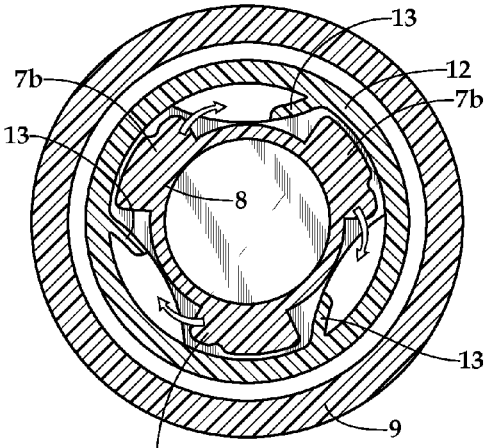
FIG. 6 is a section view of the fastening mechanism of the present invention shown in an unlocked position.

To lock the bowl 2 onto the plate 1, the male part 5 of the fastening mechanism on the bowl 2 is positioned directly on top of the female part 6 of the fastening mechanism on the plate 1 with the locking members 7 positioned in between the locking brackets 13; this is the "unlocked" position shown in FIG. 6. The bowl is then rotated clockwise on the protuberance 10*b* so that the horizontal portion 7*b* is inserted into the locking channel 15 on the locking bracket 13. This rotation stops when the inside edge (see "X" on FIG. 7) abuts up against the terminal edge (see "Y" on FIG. 1) of the locking bracket 13; this is the "locked" position shown in FIG. 5.

Figure 3:
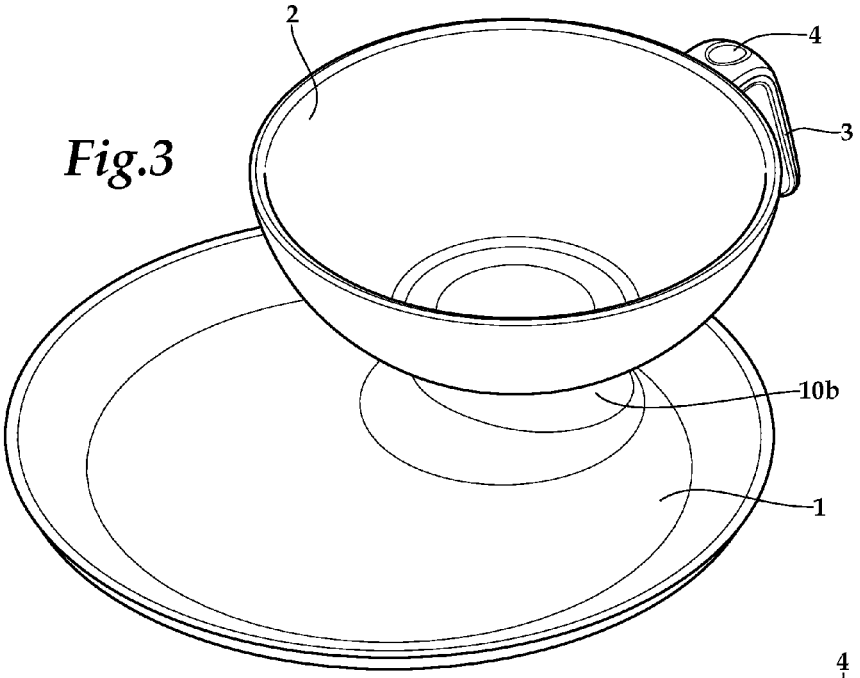
FIG. 3 is a perspective view of the present invention with the howl secured to the plate.
Figure 4:
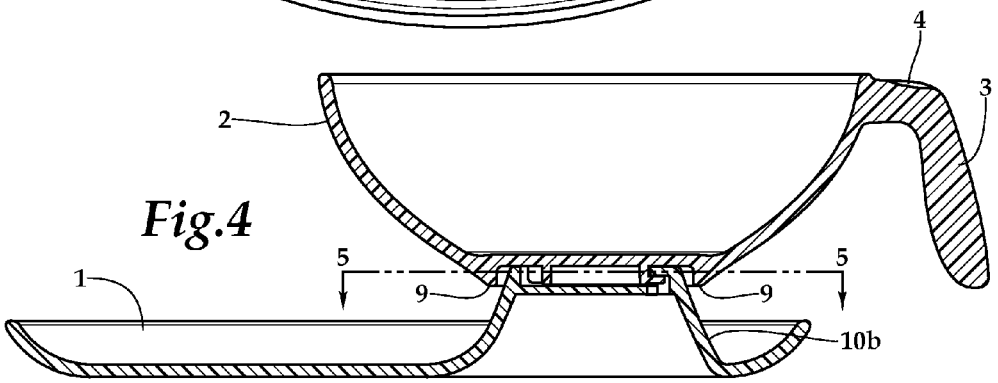
FIG. 4 is a section view of the present invention with the bowl secured to the plate.
Figure 12:
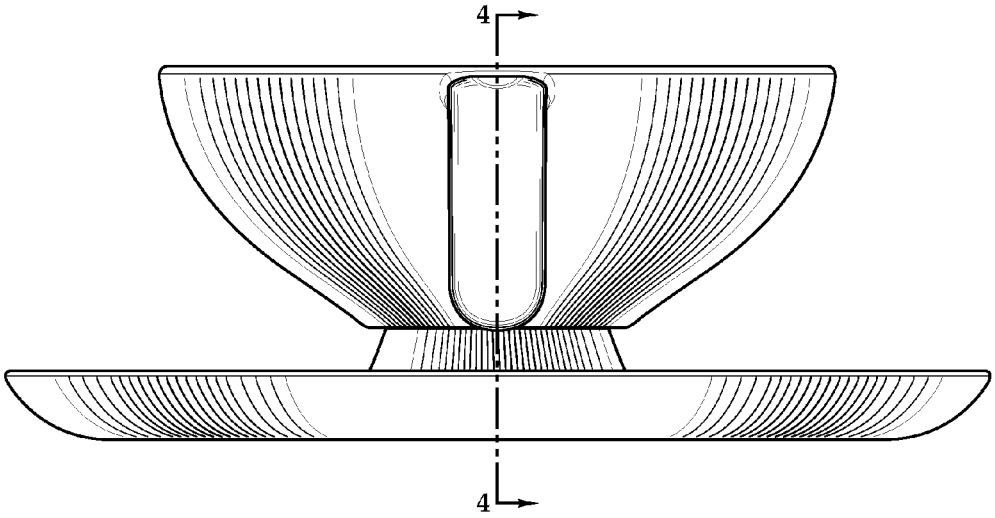
FIG. 12 is a side view of the present invention with the bowl secured to the plate.

FIG. 3 is a perspective view of the present invention with the bowl secured to the plate, and FIG. 4 is a section view of the present invention with the bowl secured to the plate (FIG. 12 shows where the section view in FIG. 4 is taken). As shown in these two figures, very little volume inside of the howl is taken up by the fastening mechanism, and the bowl cannot tilt or slide on the plate once it is in a locked position. To unlock the howl from the plate, simply rotate the bowl counterclockwise until the horizontal portions 7*b* on the locking members 7 are disengaged from the locking channels 15. The bowl can then be lifted straight up off of the plate. Thus, the plate may foe used with or without the bowl.

FIG. 5 is a section view of the fastening mechanism of the present invention shown in a locked position, and FIG. 6 is a section view of the fastening mechanism of the present invention shown in an unlocked position. The arrows in FIG. 5 indicate the direction in which one would need to rotate the bowl (on the plate) in order to unlock the bowl from the plate; the arrows in FIG. 6 indicate the direction in which one would need to rotate the bowl (on the plate) in order to lock the bowl onto the plate.

Figure 7:
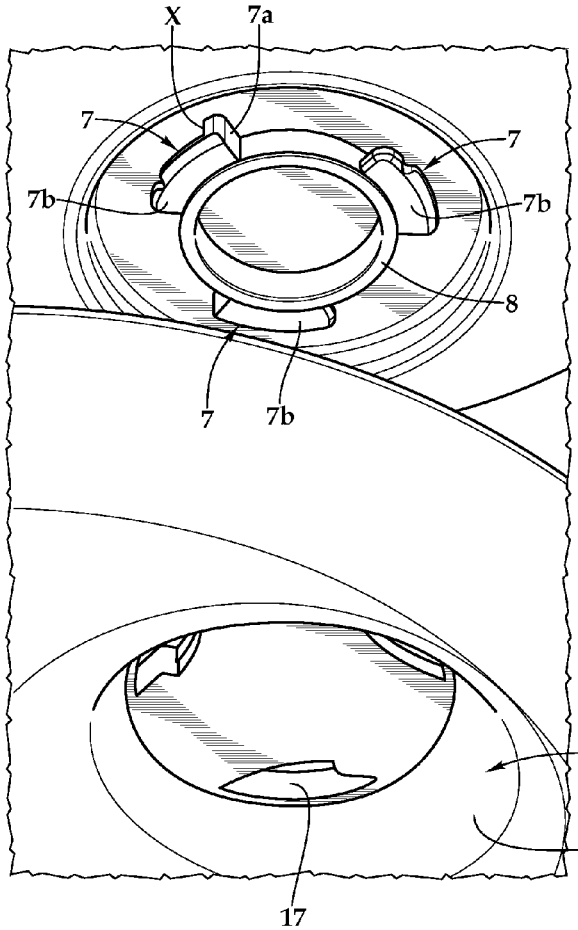
FIG. 7 is a bottom perspective view of the fastening mechanism on the bowl and plate of the present invention.
Figure 8:
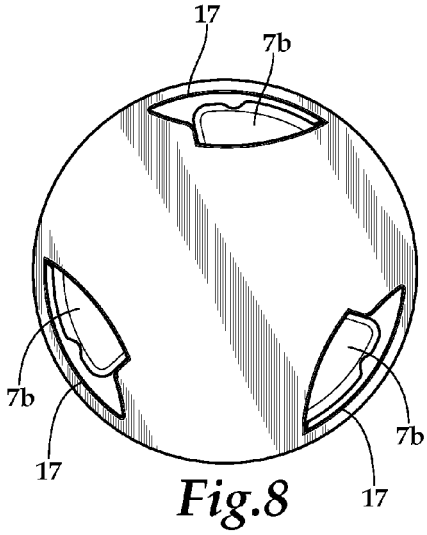
FIG. 8 is a bottom view of the fastening mechanism of the present invention shown with the bowl in a locked position on the plate.

FIG. 7 is a bottom perspective view of the fastening mechanism on the bowl and plate of the present invention, and FIG. 8 is a bottom view of the fastening mechanism of the present invention shown with the howl in a locked position on the plate. As shown in these figures, the viewing windows 17 allow one to confirm visually that the bowl is in a fully locked position.

Figure 9:
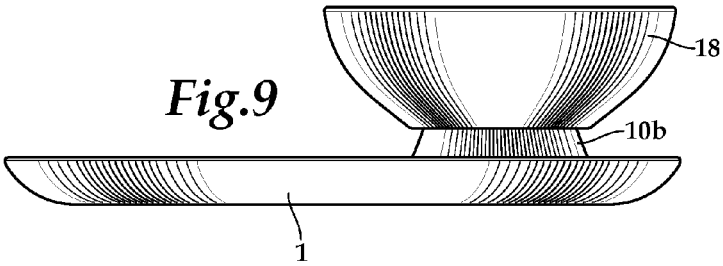
FIG. 9 is a side view of the present invention with a dipping bowl in lieu of a standard bowl.
Figure 10:
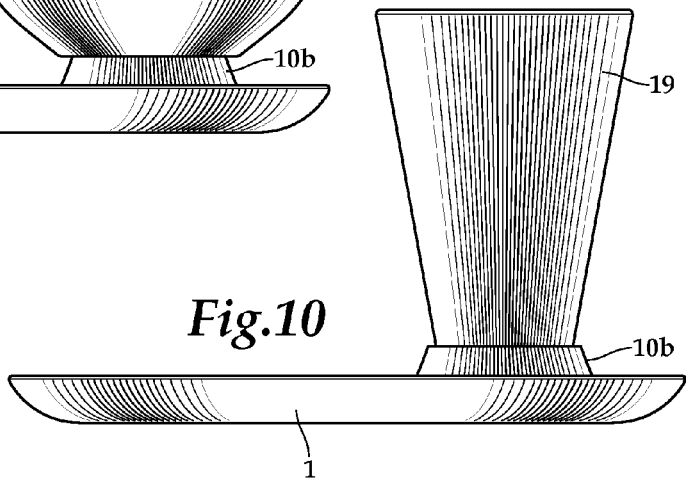
FIG. 10 is a side view of the present invention with a drinking cup in lieu of a standard bowl.

FIG. 9 is a side view of the present invention with a dipping bowl in lieu of a standard bowl, and FIG. 10 is a side view of the present invention with a drinking cup in lieu of a standard bowl. As these figures illustrate, the fastening mechanism of the present invention can be used to secure any type of bowl, cup, rang or even another plate (not shown) to tire underlying plate. The method of fastening the bowl/cup/mug/plate to the underlying plate is the same as described above. Similarly, a bowl, cup, mug or plate could be secured to a lawn chair or similar item of furniture by providing the female part 6 of the fastening mechanism on the underlying item and the male part 5 of the fastening mechanism on the bowl/cup/mug/plate.

One of the advantages of the present invention over prior art is that because the bowl is raised up off of the plate (by the protrusion 10*b*), the bowl takes up a relatively small footprint on the plate. This leaves more room for food on the plate. In addition, as noted above, the howl cannot tilt or slide when it is in a locked position on the plate, which makes it more secure than other prior art devices. The thumb grip on the bowl handle allows a person to provide additional leverage by placing a thumb on the thumb grip, and fingers may be inserted into the circular recess on the underside of the plate to provide additional leverage if a bowl or cup without a thumb grip is used. Because the bowl and plate are secured tightly to one another so as to prevent spillage, a person can hold the bowl/plate in one hand and a drink in another. Lastly, as compared to prior art (e.g., Parish), the fastening mechanism—due to its slim profile—does not take up any of the volume inside of the bowl. This presents an advantage in terms of the amount of liquid or food that can be held in the attached bowl, cup, mug or plate.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A portable combination dishware set comprising:

(a) a plate comprising a female part of a fastening mechanism, the female part comprising a circular recess on an underside of the plate, the circular recess forming a protuberance on a top surface of the plate, the protuberance terminating in a raised circular periphery, the raised circular periphery comprising a number of inwardly extending locking brackets, each locking bracket comprising an inner arcuate edge with a first end and a second end, the inner arcuate edge joining the raised circular periphery at the first end of the inner arcuate edge and at the second end of the inner arcuate edge, a locking channel situated directly underneath the arcuate edge of each locking bracket, the female part being positioned on the plate so as to leave room for food on the plate; and (b) a bowl having a bottom surface comprising a male part of the fastening mechanism, the male part comprising a number of locking members, each of the locking members comprising a vertical extension that connects the locking member to the bottom surface and a horizontal portion that extends partially around an outer circumference of a circular protrusion on the bottom surface;

wherein the number of locking brackets equals the number of locking members;

wherein each locking bracket has a height, wherein each locking channel has a floor, and wherein the floor of each locking channel is formed by a flat member that is offset from a top edge of the raised circular periphery by a distance equal to the height of each locking bracket;

wherein the flat member covers an entire inner surface area of the protuberance with the exception of cut-outs that form viewing windows;

wherein the viewing windows are located directly underneath the locking brackets; and wherein the viewing windows are configured to allow visual confirmation that the bowl is in a fully locked position.

2. The portable combination dishware set of claim 1, wherein each of the arcuate edges has a length, and wherein the locking channel extends approximately two-thirds of the length of the arcuate edge.

3. The portable combination dishware set of claim 1, wherein the bowl comprises a handle with a thumb grip.

4. The portable combination dishware set of claim 1, wherein the female part of the fastening mechanism is offset from a center of the plate and from an outer edge of the plate.

5. The portable combination dishware set of claim 4, wherein the top surface has an area, and wherein the female part comprises less than one-quarter of the top surface area of the plate.

6. The portable combination dishware set of claim 1, wherein the male part of the fastening mechanism is recessed into the bottom surface of the bowl so that no portion of the male part extends below a bottom periphery of the bottom surface, and wherein the male part is situated at a center of the bottom surface of the bowl and a certain distance from the bottom periphery of the bottom surface.

7. The portable combination dishware set of claim 6, wherein the bowl has an overall height, and wherein the male part has an overall height that is no greater than one-eighth the overall height of the piece of dishware.

* * * * *